US006261748B1

(12) United States Patent
Wada et al.

(10) Patent No.: US 6,261,748 B1
(45) Date of Patent: Jul. 17, 2001

(54) RECOVERING METHOD OF SUPPORT AND USEFUL INGREDIENT FROM IMAGE FORMING MATERIAL

(75) Inventors: Yasunori Wada; Kiyoshi Goto, both of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/585,017

(22) Filed: Jun. 1, 2000

(30) Foreign Application Priority Data

Jun. 2, 1999 (JP) ..... 11-155279

(51) Int. Cl.[7] ..... G03C 5/395
(52) U.S. Cl. ..... 430/398; 210/634
(58) Field of Search ..... 430/398; 210/634

(56) References Cited

U.S. PATENT DOCUMENTS 3,652,466 3/1972 Hittel et al. ..... 521/46
3,873,314 3/1975 Woo et al. ..... 75/713
3,982,932 * 9/1976 Korosi ..... 430/398
5,288,728 * 2/1994 Spears et al. ..... 430/398

FOREIGN PATENT DOCUMENTS 1934552 1/1970 (DE) .
4427097 2/1996 (DE) .

OTHER PUBLICATIONS

European Search Report EP 00 30 4666.

* cited by examiner

*Primary Examiner*—Hoa Van Le
(74) *Attorney, Agent, or Firm*—Jordan B. Bierman; Bierman, Muserlian and Lucas

(57) ABSTRACT

A method for recovering a resin support from an image forming material comprising a resin support having thereon an image forming layer is disclosed, in which the image forming material is immersed into a dipolar aprotic solvent or an alkaline alcohol and the image forming layer is dissolved with stirring under heat.

9 Claims, No Drawings

RECOVERING METHOD OF SUPPORT AND USEFUL INGREDIENT FROM IMAGE FORMING MATERIAL

FIELD OF THE INVENTION

The present invention relates to a method for separating an image forming layer from an image forming material and recovering a resin support or useful ingredients contained in the image forming layer.

BACKGROUND OF THE INVENTION

After employing a silver halide light sensitive photographic materials as an image forming material, silver coverage thereof has been conducted in such a way that the photographic material is allowed to be dipped in an aqueous alkali solution and stirred with heating to separate constitutional materials from the photographic material, and thereby silver is recovered from the constitutional components. Recently, however, image forming materials have undergone many changes and new type of image forming materials have been introduced, in which the components are not easily removable, such as "Dry View" available from Imation Corp., "Dry Star" 3000 available from Agfa-Gavaert AG or "Helios" available from Sterling Corp.

In conventional silver halide photographic materials, gelatin has mainly been employed as binder, which is readily soluble in an aqueous alkali solution. However, the binder(s) used in such new products as described above, which are not mainly composed of gelatin, cannot be dissolved by conventional means. As another means for recovering silver from a used silver halide photographic material is known a method in which the photographic material is subjected to combustion and silver is recovered from the residue. However, this method, in which the support is also burned, is not desirable in terms of recent environmental protection measures.

In view of the foregoing status, there is desired a method for recovering the support or other useful constituent material from new image forming materials substitutable for conventional silver halide photographic materials and a method of reuse thereof.

When image forming materials are treated in a solvent to dissolve at least a part of the solid constituent materials on the support to separate it from the support, consumption of the large amount of required solvent is not preferred in terms of the environment and cost. Further, minimal solvent or water is preferred in recovery of useful ingredients from the solution. As a means therefor, it is preferred to recover the solvent by distillation and to condense the image forming components. However, increasing the concentration rate results in an increase in viscosity, making its handling more difficult.

SUMMARY OF THE INVENTION

It is an object of the present invention to provide a method for efficiently recovering useful materials such as a resin support or other useful ingredients in the image forming layer of new type image forming materials having a layer insoluble in an aqueous alkali.

The above object of the invention can be accomplished by the following constitution:

1. A method for recovering a resin support from an image forming material comprising a resin support having thereon an image forming layer, the method comprising the steps of:

(a) immersing the image forming material into a dipolar aprotic solvent or an alkaline alcohol, and
(b) dissolving the image forming layer with stirring under heat to form an image forming layer solution;

2. The method described in 1. above, wherein the dipolar aprotic solvent is selected from the group consisting of dimethyl sulfoxide, dimethyl formamide and dimethyl acetoamide;
3. The method described in 2., wherein the method further comprises:
(c) separating the image forming layer solution from the resin support, and
(d) recovering the dipolar aprotic solvent or alkaline alcohol from the image forming layer solution;
4. The method described in 1., wherein the resin support is polyethylene terephthalate or cellulose triacetate.
5. The method described in 1., wherein in step (b), ultrasonic is employed to promote dissolution;
6. The method described in 1., wherein in step (a), after the image forming material is cut to a size of 0.1 cm×0.1 cm to 10 cm×10 cm, the image forming material immersed into the dipolar aprotic solvent or alkaline alcohol;
7. The method described in 3., wherein in step (c), after separating the image forming layer solution from the resin support, the resin support is washed with water to recover the support;
8. The method described in any of 1. through 7., wherein the resin support which has been recovered from the image forming material according to the method as described in any of 1. through 7. is reused as a support of an image forming material;
9. The method described in 1., wherein the method further comprises:
(e) recovering a useful ingredient from the image forming layer solution;
10. The method described in 9., wherein the useful ingredient is silver;
11. The method described in 9., wherein in step (e), the image forming layer solution is subjected to combustion to recover the useful ingredient;
12. The method described in 1., wherein the method further comprises:
(c1) separating the image forming layer solution from the resin support, and
(e1) adding a precipitating agent to the image forming layer solution to recover a useful ingredient therefrom;
13. A method for recovering a resin support from an image forming material comprising a resin support having thereon a sparingly water-soluble layer, wherein the image forming material further comprises a water-soluble layer, which is provided between the resin support and the sparingly water-soluble layer;
14. The method described in 13., wherein the water-soluble layer is adjacent to the resin support;
15. The method described in 13., wherein a layer containing a useful ingredient is provided between the resin support and the sparingly water-soluble layer; the water-soluble layer being the layer containing a useful ingredient, or being a layer provided between the resin support and the layer containing a useful ingredient;
16. The method described in 15., wherein the method comprising:

(a) immersing the image forming material into water,
(b) dissolving the water-soluble layer to form a water-soluble layer solution,
(c) separating a layer including the resin support from a mixture including the sparingly water-soluble layer and the water-soluble layer solution, and
(d) recovering a useful ingredient from the mixture including the sparingly water-soluble layer and the water-soluble layer solution;

17. A method for recovering a resin support from an image forming material comprising a resin support having thereon a sparingly water-soluble layer, wherein the image forming material further comprises a layer (II), which is soluble in an aqueous alkaline solution or an aqueous acid solution and provided between the resin support and the sparingly water-soluble layer;
18. The method described in 17., wherein the layer (II) is adjacent to the resin support;
19. The method described in 17., wherein a layer containing a useful ingredient is provided between the resin support and the sparingly water-soluble layer, the layer (II) being the layer containing a useful ingredient or being a layer provided between the resin support and the layer containing a useful ingredient; and
20. The method described in 19., wherein the method comprising:
(a) immersing the image forming material into an aqueous alkaline solution or an aqueous acid solution,
(b) dissolving the layer (II) to form an aqueous layer (II) solution,
(c) separating a layer including the resin support from a mixture including the sparingly water-soluble layer and the layer (II) solution, and
(d) recovering a useful ingredient from the mixture comprising the sparingly water-soluble layer and the layer (II) solution.

DETAILED DESCRIPTION OF THE INVENTION

As a result of the inventor's exploration of methods for recovering useful ingredients contained in new types of image forming materials, it was found that the use of hydrophilic organic solvents, i.e., a dipolar aprotic solvent, specifically such as dimethyl sulfoxide, dimethyl formamide or dimethyl acetoamide, or the use of low-priced alkaline alcohols was advantageous, thereby enabling recovery or reuse of useful ingredients from image forming materials which are not mainly composed of gelatin, such as "Dry View" available from Imation Corp., "Dry Star" 3000 available from Agfa-Gavaert AG or "Helios" available from Sterling Corp.

Herein, the dipolar aprotic solvent refers to a polar solvent comprised of polar molecules and having no protic hydrogen.

The present invention can be applied not only to a specific type of image forming materials but also to any one which contains a useful ingredient in an image forming material or has a reusable support. An image forming material usable in the invention comprises a resin support having thereon at least one image forming layer. Exemplary examples thereof include image forming materials, which comprise a resin support such as polyethylene terephthalate, polyethylene naphthalate, cellulose triacetate or syndiotactic polystyrene, provided on the support with a photothermographic recording layer (such as "Dry Silver"), a thermal recording layer or a thermal transfer layer. A binder used in these layers is not gelatin but is often a water-insoluble binder, such as polyvinyl butyral, cellulose acetate type polymers, or polyvinyl alcohol. Such image forming materials include, for example, Dry Silver-type photothermographic materials, ink-jet system image receiving materials, ablation-type image forming materials, thermal recording materials and thermal transfer materials. Specifically, Dry Silver-type materials, which contain silver components are important in terms of recovery of natural resources.

The image forming material used in the invention may be treated as such but component layers sometimes are not sufficiently dissolved out due to overlapping of image forming materials. Such cases are not preferred, often leading to lowering the recovery efficiency of useful ingredients or deteriorated quality of a support. Installation of a baffle plate in a dissolving tank, selection of stirring blades or speed-up of stirring can result in improvements to some extent but is usually not sufficient. It was proved that dissolution of the image forming layer of an image forming material was markedly improved by cutting the image forming material to a given small size. Thus, it is preferred to cut it from a size of 0.1 cm×0.1 cm to 10 cm×10 cm, more preferably 0.1 cm×0.1 cm to 2 cm×2 cm, and still more preferably 0.1 cm×0.1 to 1 cm×1 cm. Further the use of ultrasonic agitation enables not only complete dissolving-out but also shortens the time for the process.

In cases when using a dipolar aprotic solvent such as dimethyl sulfoxide, dimethyl formamide or dimethyl acetoamide, the dissolving temperature is 20 to 180° C., preferably 40 to 150° C., and more preferably 60 to 120° C. The boiling point of dimethyl sulfoxide, dimethyl formamide and dimethyl acetoamide is 179° C., 153° C. and 165° C., respectively, so that reflux extraction (or Soxhlet extraction) is preferably employed. Further, as a means for enhancing the extraction efficiency or the extraction rate is preferably employed ultrasonic.

After dissolving with dimethyl sulfoxide, dimethyl formamide, dimethyl acetoamide or alkaline alcohol to remove the image forming layer, it is preferred to wash the resin support with water. The use of the water-soluble solvents described above causes no separation of water and the solvent, making washing easier. The use of water sometimes causes precipitation of a sparingly water-soluble ingredient from the solution attached to the support. In such a case, after separating the precipitate, the support is again washed with a solvent, thereby leading to marked enhancement in washing efficiency, as compared to the case without washing with water. The recovered support is superior in purity, causing no deterioration in transparency, as compared to the use of other solvents.

Although the dipolar aprotic solvents such as dimethyl sulfoxide, dimethyl formamide or dimethyl acetoamide was proved to be superior in separation of an image forming layer from an image forming material compared to commonly used solvents, such a dipolar aprotic solvent is relatively high-priced. It was further found that the use of an alcohol added with an alkali exhibited superior separation efficiency. Alkaline alcohol is an alcohol in which an alkali such as caustic potash (or potassium hydroxide), caustic soda (or sodium hydroxide), sodium methoxide or sodium ethoxide is dissolved preferably in an amount of 1 to 30%, and more preferably 20 to 30%, and which may contain a small amount of water. Examples of the usable alcohol include lower alcohols such as methanol, ethanol and isopropanol. The alkaline alcohols can be employed as a solvent in a manner similar to the aprotic solvents such as dimethyl formamide. The alkaline alcohols, which exhibit a low boiling point must be used at a low temperature enough to cause no evaporation thereof or in an apparatus in which evaporation scattering is prevented by evaporation under reflux. The thus recovered support may be reused as a support or used for other purposes.

Next, a method for recovering a useful ingredient in an image forming layer will be described. In the case of the useful ingredient being silver, commonly known recovering methods thereof include, for example, a cyanide process, a by-product recovering process and an amalgam process. A dimethyl sulfoxide, dimethyl formamide or dimethyl acetoamide solution of an image forming materials can form a slurry containing an insoluble component. The solution may be subjected to combustion as such to recover useful ingredients such as silver, but condensation by distillation or recovery of solvents is preferred. In this case, heat-exchange is preferably conducted between heating for dissolution and cooling the distilled solvent through a heat pump. Further, allowing an ingredient thickening the solution to precipitate prior to distillation lowers the viscosity after distillation and condensation. As a means for separation of the thickening ingredient or for precipitating this ingredient to perform direct separation of a useful ingredient is preferably employed addition of a poor solvent or salting-out. Poor solvents, which are dependent of the kind of binder, include, for example, water in the case of a sparingly water-soluble binder. Further, in the case of an alkaline alcohol, precipitation can be achieved with acids. Alternatively, to allow a specifically useful ingredient to precipitate is employed a characteristic inherent to the ingredient. Thus, a compound or an ingredient capable of forming a molecular compound or inclusion compound can be added to perform separation. For example, tetraphenylphosphonium chloride is added to separate a specific phenol compound. In cases where the useful ingredient is silver, for example, after removing any material causing an increase in viscosity, solvents are recovered by distillation to reduce the volume and silver is recovered by the afore-mentioned cyanide process, a by-product recovering process or an amalgam process.

Further, as a method for separating the image forming layer, the following is a useful method. Thus, in cases where a component layer of an image forming material is sparingly soluble in water or solvents, a water-soluble layer is provided, thereby making it possible to recover useful ingredients such as silver or a support. In the case of the upper layer being sparingly soluble, it takes a given time to be able to peel off the upper layer. In such a case, it was found that the upper layer could be clearly peeled off by cutting the image forming material into small chips. It was further proved that the peeled image forming layer can be separated from the support by filtration. For the purpose of recovery of a useful ingredient such as silver from an image forming material, the water-soluble layer may be a layer containing the useful ingredient or may be provided between a support and a layer containing the useful ingredient. For the purpose of reuse of a support, it is preferred to make a layer adjacent to the support water-soluble. In the invention, the expression "water-soluble" means being soluble in water at a pH of 6 to 8 in an amount of at least 0.5 g, preferably at least 1 g, and more preferably at least 10 g per liter. In the case of being soluble in an aqueous alkaline or acidic solution, it means being soluble in an aqueous solution at a pH of not lower than 8 or not higher than 6 in an amount of at least 0.5 g, preferably at least 1 g, and more preferably at least 10 g per liter. The expression "sparingly water-soluble" means being hardly soluble in water, hardly soluble in an aqueous alkaline solution and hardly soluble in an aqueous acid solution. According to the foregoing method, a component layer can be separated from the support without using an expensive solvent. And in cases where a useful ingredient-containing layer is sparingly water-soluble, the layer can be treated as a solid material, which can be further reduced in volume by filtration. In this case, it is preferred to provide a layer comprised of a water-soluble polymer, as a water-soluble layer. The water-soluble polymer is preferably one which exhibits a solubility of at least 1 g per liter of water, and preferably at least 10 g per liter of water. Preferred examples thereof include sodium sulfonate group-containing polymers, such as poly (styrenesulfonic acid). When satisfying such solubility criteria, component layers including an image forming layer intended for sufficient recovery can be separated from the support. In application to image forming materials, however, a binder which is merely water-soluble reduces resistance to peeling or abrasion mark, so that compatibility with performance of the image forming material can preferably be achieved by selecting a binder which is water-insoluble and soluble in an aqueous alkaline or acid solution. Binders in such a layer can employ commonly known ones, including, for example, acid group-containing polymers. Specifically, carboxylic acid group-containing polymers are commonly employed, which are advantageous in terms of cost, the kind and handleability. Exemplary examples thereof include polymers containing acrylic acid, methacrylic acid, a methacrylic acid ester or phthalic acid. Further, those which are in the form of a latex are also usable.

In the invention, a resin support can be separated from an image forming layer according to any of the foregoing methods. The resin support is thus recovered and is reusable. Useful ingredients such as silver can also be recovered from the separated solution or a layer of the image forming material. In cases where the solution contains the useful ingredient, prior to recovery of a solvent, an ingredient capable of making the solution viscous is allowed to precipitate by addition of a poor solvent or salting-out and be separated from the solution, and the solvent is recovered and condensed, followed by recovery of the useful ingredient. In the case of the useful ingredient being silver, silver recovery can be achieved by a cyanide process, a by-product recovering process or an amalgam process. Alternatively, after the residue is subjected to combustion, silver can be recovered from the remaining ashes.

The present invention can be applied to recovery and reuse of not only silver but also other useful ingredients. In this case, recovery thereof can be achieved by selection of a treatment method suitable for the properties of the ingredient to be recovered, after separation from the support. Thus, using the foregoing methods, a support and a coat can be separated, the support can further be separated therefrom, whereby the support and/or any useful ingredient in an image forming layer can be recovered.

Next, as one embodiment of representative image forming materials usable in the invention, photothermographic materials will be described. The photothermographic material is constituted as follow.

Photothermographic materials are thermally processed to form photographic images, comprising a support having thereon an image forming layer containing a reducible silver source (e.g., an organic silver salt), light-sensitive silver halide, a reducing agent and optionally a tone modifier controlling image tone, which are usually in the form dispersed in an (organic) binder matrix. There may be optionally provided a protective layer, a backing layer or a subbed layer.

Silver halide used in the photothermographic material functions as a photosensor. Halide composition thereof is not specifically limited and various silver halides such as silver chloride, silver chlolobromide, silver iodochlorobromide, silver bromide, silver iodobromide and silver iodide are employed. Silver halide is contained usually in an amount of 0.75 to 30% by weight, based on an organic silver salt. In this regard, image forming materials containing no light-sensitive silver halide are employed as a heat-mode image forming material.

The organic silver salt is a reducible silver source, i.e., an organic acid containing a reducible silver ion source. The organic acids include, for example, aliphatic carboxylic acids, carbocyclic carboxylic acids, heterocyclic carboxylic acids and heterocyclic compounds. Of these, long-chained aliphatic carboxylic acids (having 10 to 30 carbon atoms, and preferably 15 to 25 carbon atoms) and nitrogen-containing heterocyclic carboxylic acids are preferably employed.

Exemplary examples of organic silver salts are described in Research Disclosure (hereinafter, also denoted as RD) 17029 and 29963, including silver salts of fatty acid (e.g., silver salts of gallic acid, oxalic acid, behenic acid, arachidic acid, stearic acid, palmitic acid, lauric acid); silver salts of carboxyalkylthiourea [e.g., 1-(3-carboxypropyl)thiourea, 1-(3-carboxypropyl)-3,3-dimethylthiourea; a silver complex of the polymer reaction product of an aldehyde and a hydroxy-substituted aromatic carboxylic acid (e.g., aldehydes such as formaldehyde, acetoaldehyde and butylaldehyde, and hydroxy-substituted acids such as salicylic acid, benzylic acid, 3,5-dihydroxybenzoic acid, and 5,5-thiodisalicylic acid); silver salts and their complex [e.g., 3-(2-carboxyethyl)-4-hydroxymethyl-4-thiazoline-2-thioene, 3-carboxymethyl-4-methyl-4-thiazoline-2-thioene]; salts or complexes of silver and a nitrogen acid selected from imidazole, pyrazole, urazole, 1H-tetrazole, 3-amino-5-benzylthio-1,2,4-triazole and benzotriazole; and silver salts of mercaptides. Of organic silver salts described above are preferably employed silver salts of fatty acid, and silver behenate, silver arachidate and silver stearate are more preferred.

Aqueous organic silver salt dispersion, for example, can be prepared in such a manner that an alkali metal hydroxide (e.g., sodium hydroxide, potassium hydroxide) is added to an organic acid to form an alkali metal salt soap of the organic acid (e.g., sodium behenate, sodium arachidate) and further thereto are added silver nitrate and silver halide by the double jet addition.

Reducing agents are included in the photothermographic material. Examples of reducing agents are described in U.S. Pat. Nos. 3,770,448, 3,773,512, and 3,593,863, and Research Disclosure Items 17029 and 29963, and include the following: aminohydroxycycloalkenone compounds (e.g., 2-hydroxypiperidino-2-cyclohexane); esters of amino reductones as the precursor of reducing agents (e.g., piperidinohexose reducton monoacetate); N-hydroxyurea derivatives (e.g., N-p-methylphenyl-N-hydroxyurea); hydrazones of aldehydes or ketones (e.g., anthracenealdehyde phenylhydrazone; phosphamidophenols; phosphamidoanilines; polyhydroxybenzenes (e.g., hydroquinone, t-butylhydroquinone, isopropylhydroquinone, and (2,5dihydroxy phenyl)methylsulfone); sulfydroxamic acids (e.g., benzenesulfhydroxamic acid); sulfonamidoanilines (e.g., 4-(N-methanesulfonamide)aniline); 2-tetrazolylthiohydroquinones (e.g., 2-methyl-5-(1-phenyl-5-tetrazolylthio)hydroquinone); tetrahydroquionoxalines (e.g., 1,2,3,4-tetrahydroquinoxaline); amidoxines; azines (e.g., combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (e.g., 2,6-dimethoxy-3,5-dicarboethoxy-1,4-dihydropyridine); bisphenols (e.g., bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones.

In addition to the foregoing, a surfactant, an antioxidant, a stabilizer, a plasticizer, a UV absorbent and a coating aid may be employed in photothermographic materials.

Suitable binder usable in photothermographic materials are transparent or translucent, and generally colorless. Binders are resins synthesized from natural polymers, polymers and copolymers, and other film forming media; for example, gelatin, gum arabic, poly(vinyl alcohol), hydroxyethyl cellulose, cellulose acetate, cellulose acetatebutylate, poly(vinylpyrrolidone), casein, starch, poly(acrylic acid), poly(methylmethacrylic acid), poly(vinyl chloride), poly(methacrylic acid), copoly(styrene-maleic acid anhydride), copoly(styrene-acrylonitrile, copoly (styrene-butadiene, poly(vinyl acetal) series (for example, poly(vinyl formal) and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic. Of these polymers are preferred polyacrylic acid esters such as polymethyl methacrylate, copolystyrene butadiene, polyvinyl acetals, cellulose esters and polyurethanes. There may be provided a light-insensitive layer on the outer side of a light-sensitive layer to protect the surface of a photographic material or prevent abrasion marks. Binder used in the light-insensitive layer may be the same as or different from that used in the light-sensitive layer.

To prevent image deformation after processing are plastic film supports, such as polyethylene terephthalate, polyethylene naphthalate, polycarbonate, polyimide, nylon, cellulose triacetate, and syndiotactic polystyrene.

According to the invention, using photothermographic materials described previously, useful ingredients such as silver and a resin support could be readily recovered by separating coat from the support and treating the separated solvent phase, using a specific solvent or its mixture solvent.

EXAMPLES

Embodiments of the present invention will be described based on examples but the invention is not limited to these.

Example 1

Preparation of Support

Both surfaces of a blue-tinted 175μm PET film, exhibiting a blue density of 0.170 (measured with a densitometer, PDA-65, available from Konica Corp.), was subjected to corona discharging at 8 $w/m^2 \cdot min$.

Preparation of Light-sensitive Silver Halide Emulsion

Preparation of Silver Halide Emulsion A

In 900 ml of water were dissolved 7.5 g of ossein gelatin having an average molecular weight of 100,000 and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06μm, a variation coefficient of the projection area equivalent diameter of 12 percent, and the proportion of the {100} face of 87 percent. The resulting emulsion was subjected to flocculation washing to remove soluble salts, employing a flocculating agent and after desalting, 0.1 g of phenoxyethanol was added and the pH and pAg were adjusted to 5.9 and 7.5, respectively to obtain a light sensitive silver halide emulsion.

Preparation of Organic Silver Salt Compound

In 9450 ml of water were dissolved at 80° C. 233 g of behenic acid, 157 g of arachidic acid and 110 g of stearic acid. Then, 1000 ml of an aqueous 1.5M sodium hydroxide solution was added thereto with stirring at a high speed. Subsequently, after adding 13.8 ml of 60% nitric acid, the reaction mixture was cooled to a temperature of 55° C., stirred further for 30 min. and the silver halide emulsion described above (containing 0.08 mol silver and 900 ml water) was added in 5 sec. After stirring for 5 min., 1410 ml of a 1M silver nitrate solution was added in 2 min., stirred for 20 min. and then filtered to remove soluble salts. Thereafter, washing with deionized water and filtration were repeated until the conductivity of the filtrate reached 2 μS/cm, and after subjected to centrifugal dehydration, the reaction product was dried with hot air at 37° C. until no reduction in weight was observed to obtain a powdery organic silver salt compound.

Preparation of Light-sensitive Emulsified Dispersion

Polyvinyl butyral powder (B-79, available from Monsanto Co.) of 14.6 g was dissolved in 1475 g of methyl ethyl ketone and 500 g of powdery organic silver salt compound was gradually added thereto and sufficiently mixed with stirring by a dissolver type homogenizer. Thereafter, the mixture was dispersed by a media-type dispersing machine (produced by Gettzmann Corp.) 80%-packed with 1 mm Zr beads (produced by Toray Co. Ltd.) at a circumferential speed of 13 m and a mill-retention time of 0.5 min. to obtain a light sensitive emulsion-dispersing solution.

Preparation of Coating Composition of Light-sensitive Layer

The following additives were added in this order to obtain a coating composition of a light sensitive layer.

| | |
|---|---|
| Light sensitive emulsion dispersion solution | 50 g |
| Antifoggant 1 (10% methanol solution) | 0.4 ml |
| Calcium bromide (10% methanol solution) | 0.9 ml |
| Polyvinyl butyral (B-79, available from Monsanto Co.) | 13.3 g |
| Phthalazinone | 0.3 g |
| Tetrachlorophthalic acid | 0.1 g |
| 4-Methylphthalic acid | 0.14 g |
| Infrared dye 1 | 37 mg |
| Antifoggant (20% MEK solution) | 5.0 ml |
| Developer 1,1-bis(2-hydroxy-3,5-dimethylphenyl)-2-methyl propane (20% MEK solution) | 12.5 ml |
| Desmodul N3300 (available from Movey Co., aliphatic isocyanate, 10% MEK solution) | 1.60 ml |

Infrared Dye 1

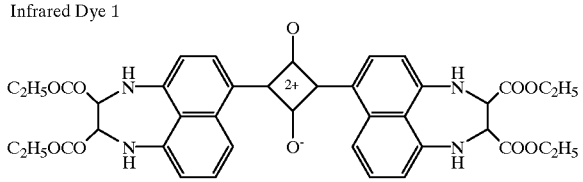

Antifoggant 1

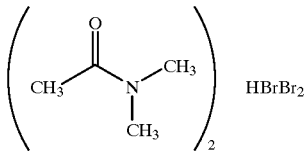

Antifoggant 2

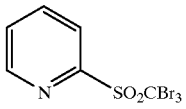

On the support, the following layers were successively coated to obtain a photothermographic material. Drying was conducted at 75° C. over a period of 5 min.

Back Layer Coating

Cellulose acetate butylate (10% MEK solution) 15 ml/m$^2$

Matting agent (monodisperse silica of mono-dispersity of 15% and av. size of 10μm) 30 mg/m$^2$ Light-sensitive Layer Coating Light-sensitive Layer The coating composition of the light-sensitive layer was coated in a coating amount of 2 g/m$^2$.

Protective Layer

The following composition was coated on the light-sensitive layer.

| | |
|---|---|
| Methyl ethyl ketone | 17 ml/m$^2$ |
| Cellulose acetate | 2.3 g/m$^2$ |
| Matting agent (monodisperse silica of mono-dispersity of 15% and av. size of 10 μm) | 70 mg/m$^2$ |

A photothermographic material was obtained as image forming material 1.

Evaluation of Separability

The thus prepared photothermographic material of 1 m$^2$ was cut to a size of 5 mm×5 mm and stirred in 1 lit. solvent as shown below at a temperature of 70° C. to separate the image forming layer. The separation time was represented by a time necessary to remove 98% of the composition, based on the weight at the dried state, provided that the separation time of more than 1 hr. was represented by "-". Results are shown in Table 1.

TABLE 1

| Solvent | Temperature | Separation Time | Remark |
|---|---|---|---|
| DMSO | 70 (° C.) | 5 (min.) | Inv. |
| DMF | 70 | 5 | Inv. |
| DMAC | 70 | 5 | Inv. |
| MEK | 70 | 15 | Comp. |
| IPA | 70 | — | Comp. |
| IPA + alkali* | 70 | 6 | Inv. |
| Aq. alkali** | 70 | — | Comp |

TABLE 1-continued

| Solvent | Temperature | Separation Time | Remark |
|---|---|---|---|
| *10% KOH | | | |
| **Aqueous 10% KOH solution | | | |
| DMSO: Dimethyl sulfoxide | | | |
| DMF: Dimethyl formamide | | | |
| DMAC: Dimethyl acetoamide | | | |
| MEK: Methyl ethyl ketone | | | |
| IPA: Isopropanol | | | |

As can be seen from Table 1, it was proved that the present invention exhibited superior separability, as compared to the use of MEK or IPA.

Example 2

Constitution composition of the image forming material of 100 g was dissolved in DMF to make 1 lit. Then, the solvent was allowed to evaporate until reached a solid percentage as shown in Table 2 and the viscosity thereof was measured. Separately, after adding the following precipitating agent to the DMF solution, similarly, the solvent was evaporated and the viscosity was measured. Results thereof are shown in Table 2.

TABLE 2

| Precipitating Agent | Viscosity (cp) | | |
|---|---|---|---|
| (Add. Amt., wt %) | 10 wt % | 30 wt % | 50 wt % |
| — | 300 | 500 | 2000 |
| Water (15 wt %) | 50 | 100 | 300 |
| NaCl (5 wt %) | 100 | 200 | 500 |

As can be seen from Table 2, it was shown that when being condensed after salting-out, the viscosity of the solution was lower than the case without salting-out. It was further proved that since precipitated material was treated as solid, handling characteristics were superior.

Example 3

Preparation of Image Forming Material 2

Image forming material 2 was prepared in a manner similar to image forming material 1 of Example 1, provided that on the support used in Example 1, acrylic resin of 1 g/m$^2$ was coated to form an alkali-soluble layer.

Preparation of Image Forming Material 3

Image forming material 3 was prepared in a manner similar to image forming material 1 of Example 1, provided that on the support used in Example 1, styrenesulfonic acid resin of 1 g/m$^2$ was coated to form an water-soluble layer.

Using solvents shown in Table 3, image forming materials 1, 2 and 3 were evaluated with respect to separability similarly to Example 1. Further, after allowed to stand under environments at 25° C. and 80% RH for a given period of time, the image forming materials were evaluated with respect to scratch resistance. The scratch resistance was represented by the weight at the time a scratch mark was produced when 100$\mu$m sapphire needle was moved with increasing a loaded weight.

TABLE 3

| Image Form-Materials | Solvent | Temperature (° C.) | Separation (min.) | Scratch Resistance |
|---|---|---|---|---|
| 1 | Water | 90 | — | 32 |
| 2 | Water | 90 | — | 45 |
| 3 | Water | 90 | 30 | 15 |
| 1 | Alkali* | 90 | — | 32 |
| 2 | Alkali* | 90 | 20 | 45 |
| 3 | Alkali* | 90 | 15 | 15 |

*Aqueous 20% KOH solution

As can be seen from Table 3, according to the introduction of a water-soluble sublayer, the image forming layer can be separated by use of water, though the scratch resistance was slightly lowered. According to the introduction of an alkali-soluble sublayer, the image forming layer and the support were separated and recovered, without lowering the scratch resistance.

What is claimed is:

1. A method for recovering a resin support from an image forming material, said image forming material comprising a resin support, a sparingly water-soluble layer on said resin support, and a layer (II) between said resin support and said sparingly water-soluble layer, said layer (II) being soluble in an aqueous alkaline solution or an aqueous acid solution, said method comprising:

(a) immersing said image forming material in an aqueous alkaline solution or an aqueous acid solution;

(b) dissolving said layer (II) to form an aqueous layer (II) solution; and (c) separating and recovering said resin support from a mixture comprising said layer (II) solution and said sparingly water-soluble layer.

2. The method of claim 1 comprising (d) recovering a useful ingredient from said mixture.

3. The method of claim 2 wherein the useful ingredient is silver.

4. The method of claim 1 wherein the layer (II) is adjacent to the resin support.

5. The method of claim 1 wherein a layer containing a useful ingredient is provided between the resin support and the sparingly water-soluble layer, the layer (II) being the layer containing the useful ingredient or being a layer provided between the resin support and the layer containing a useful ingredient.

6. The method of claim 5 comprising:

(d) recovering a useful ingredient from the mixture including the sparingly water-soluble layer and the layer (II) solution.

7. The method of claim 6 wherein the useful ingredient is silver.

8. The method of claim 1 wherein, in step (a), the image forming material is cut to a size of from 0.1 cm×0.1 cm to 10 cm×10 cm, before being immersed into the aqueous alkaline solution or the aqueous acid solution.

9. The method of claim 2 wherein in step (a), the image forming material is cut to a size of from 0.1 cm×0.1 cm to 10 cm×10 cm before being immersed into the aqueous alkaline solution or the aqueous acid.

* * * * *